United States Patent [19]

Glover et al.

[11] 4,034,172

[45] July 5, 1977

[54] HIGH VOLTAGE CONNECTOR WITH CROW BAR

[75] Inventors: Douglas Wade Glover, Harrisburg; Jan Philip Askman, Carlisle; Henry Otto Herrmann, Jr., Mount Joy, all of Pa.

[73] Assignee: AMP Incorporated, Harrisburg, Pa.

[22] Filed: Mar. 19, 1976

[21] Appl. No.: 668,356

[52] U.S. Cl. ..... 200/51.1; 339/75 R; 339/75 M; 339/111

[51] Int. Cl.[2] ..... H01R 33/30

[58] Field of Search ..... 200/51.09, 51.10, 51.11; 339/111, 75 R, 75 M

[56] References Cited

UNITED STATES PATENTS 1,911,513 5/1933 Kenerson ..... 200/51.1

3,843,854 10/1974 Mori et al. ..... 200/51.09

3,944,316 3/1976 Newman et al. ..... 339/111

*Primary Examiner*—Thomas J. Kozma

[57] ABSTRACT

The disclosure relates to mateable electrical connector block for connecting or disconnecting plural electrical signal lines one at a time when the blocks are mated together or uncoupled as the case may be; with sequent connections being separated from each other a maximum distance across the connector blocks thereby eliminating arcing over between such connections as they are being made or disconnected. The connector blocks further include means for automatically disconnecting residual high voltage from the contacts when the connector blocks are uncoupled from each other and the high voltage carrying contacts become dangerously exposed thereby.

4 Claims, 8 Drawing Figures

HIGH VOLTAGE CONNECTOR WITH CROW BAR

BACKGROUND OF THE INVENTION

There has been a need in the prior art to provide high voltage cables with connector blocks which carry intermating electrical terminals electrically secured to the ends of the cables. The connector blocks usually carry plural cables which supply high voltage to a load or a current source and comprise the return circuit path from the load or current source. When the connector blocks are disconnected from each other the load or current source may have some residual voltage even though supply voltage has been disconnected. The contacts of an unmated connector block are exposed and thereby provide a danger of electrical shock from the residual voltage. One way to minimize the danger of electrical shock is to recess the exposed electrical contacts as far as possible within the confines of the connector block. The contacts although recessed are yet exposed and freely accessible through the connector block cavities. The present invention provides a shunting device which automatically disconnects the contacts within a connector block from residual high voltage immediately upon uncoupling the connector block from a corresponding intermateable connector block. The high voltage is automatically restored to the contacts by disconnecting the shunting device upon intermating the connector block with another connector block, the presence of which additonally prevents access to the high voltage contacts.

It is desirable to provide both high voltage conductors and signal conductors in a single connector block. This is made possible in large part by superior dielectric materials which prevent arcing over among the grouped signal paths of lines. Yet there exists the possibility of arcing over through air space when the connector blocks are unmated and the signal lines are grouped closely adjacent one another. Such arcing over usually occurs as the connector blocks are being mated or uncoupled from each other. The present invention minimizes the phenomenon by connecting or disconnecting the signal lines one at a time as the blocks are mated together or uncoupled, as the case may be, sequent connections being separated from each other a maximum distance across the connector block to eliminate arcing over between the signal lines. Dielectric sleeves plug cavities containing unmated contacts further preventing arcing over.

BRIEF DESCRIPTION

A pair of intermateable blocks are disclosed which are fabricated from a dielectric material and which have cavities containing substantially recessed male electrical terminals connected to electrical signal lines at various voltages. The contacts are at different recessed depths within the cavities such that when the connector blocks are mated together electrical connections to the contacts are made one at a time, or sequentially. Sequent connections are separated from each other a maximum distance across the connector blocks to eliminate arcing over between the connections as they are being made or disconnected. A dielectric piston carrying a shunting device is connected across the high voltage contacts within the connector block electrically shorting out residual voltage when the connector block is in an unmated condition. The shunting device is automatically disconnected from the high voltage contacts as the piston is displaced by mating the connector blocks together.

OBJECTS

It is an object of the present invention to provide means for disabling the high voltage carrying contacts of a connector block when the contacts are exposed thereby invoking a danger of electrical shock.

Another object of the present invention is to provide a connector block which contains high voltage carrying contacts with a means for automatically disconnecting the residual high voltage from the contacts when the connector block is uncoupled from mating engagement with another connector block and the high voltage carrying contacts are thereby dangerously exposed.

Another object is to provide a connector block with means which automatically disconnects high voltage carrying contacts from a source of high voltage when the contacts are dangerously exposed, which means become deactivated automatically upon mating engagement of the connector block with another connector block thereby to connect the high voltage to the contacts.

Another object of the present invention is to provide mateable electrical connector blocks for connecting or disconnecting plural electrical signal lines one at a time as the blocks are mated together or uncoupled, as the case may be; with sequent connections being separated from each other a maximum distance across the connector blocks and with dielectric material blocking the connections prior to their being coupled thereby eliminating arcing over between connections as they are being mated or disconnected.

DETAILED DESCRIPTION

Figure 1:
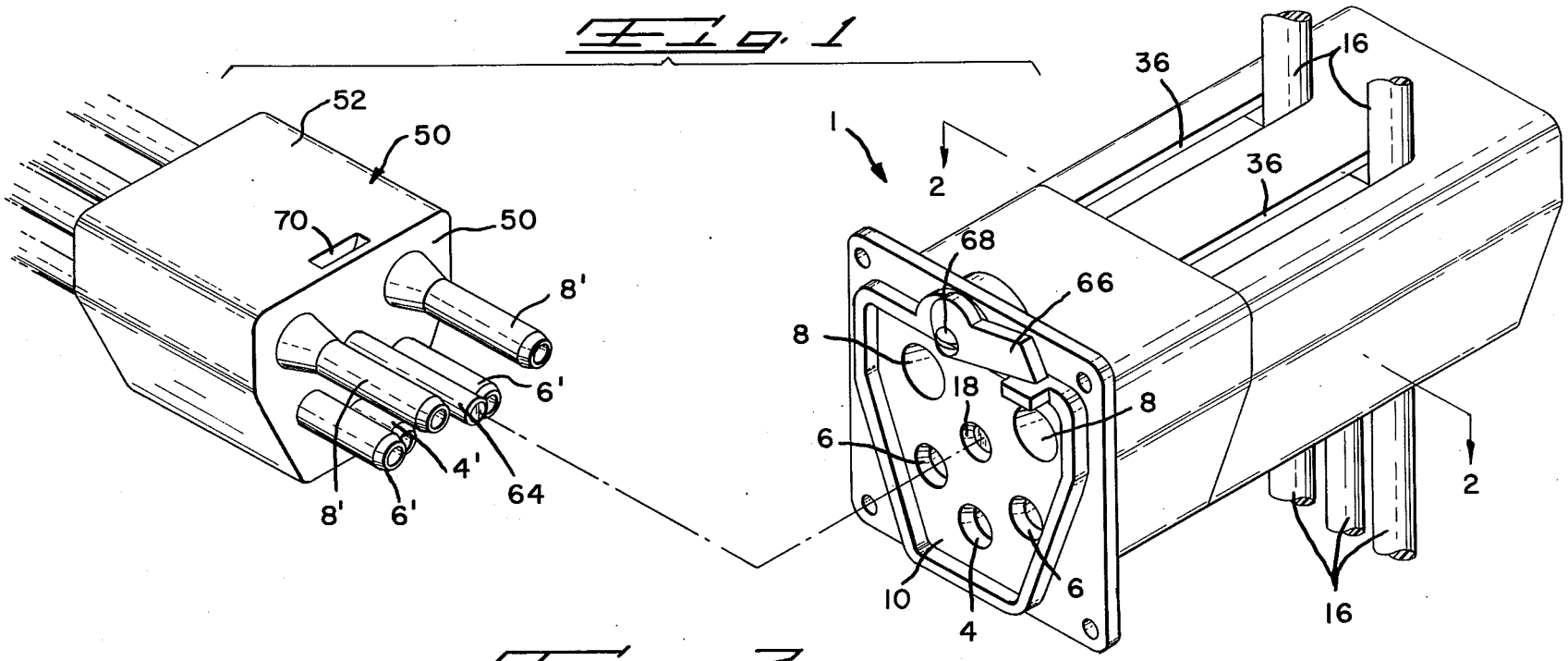
FIG. 1 is a fragmentary perspective of intermateable connector blocks according to the present invention.
Figure 2:
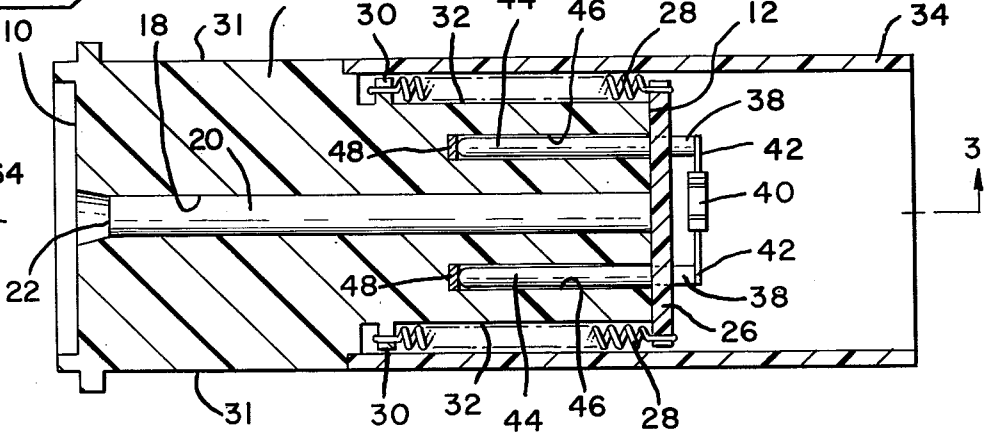
FIG. 2 is an elevation in section taken along the lines 2—2 of FIG. 1.
Figure 3:
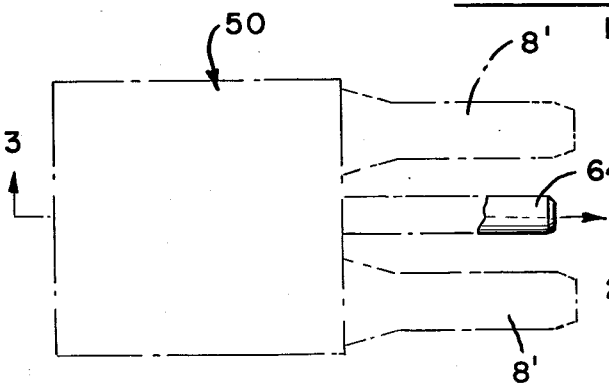
FIG. 3 is a longitudinal section taken along the lines 3—3 of FIG. 2.
Figure 3:
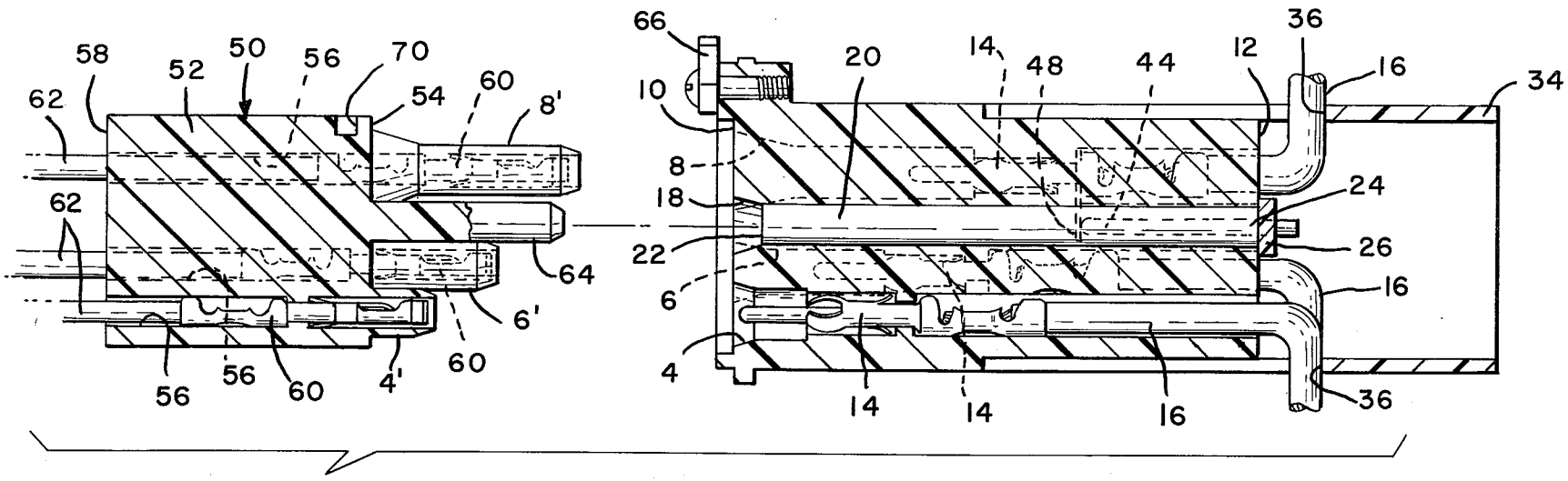

With more particular reference to FIG. 1 of the drawings there is shown generally at 1 in FIG. 1 a connector block according to the present invention. The block 1 is fabricated of a molded dielectric material and takes the form of a dielectric body portion 2 provided with a first internal cavity 4, a pair of intermediate cavities 6 and a second pair of cavities 8 all of which cavities are parallel one another and extend from a forward end 10 to a rearward end 12 of the body portion 2. As shown more particularly in FIG. 3 each of the cavities 4, 6 and 8 include an enlarged flared entryway at the front end 10. Internally of each cavity is disposed a male electrical contact 14 of any type well-known in the art latchably secured within a corresponding cavity according to a usual practice in the art. Each contact 14 is electrically connected to an insulation covered electrical conductor 16 according to well-established practice in the art. The male contacts thereby provide means for quickly connecting or disconnecting the conductors 16. The body portion 2 further is provided with a central chamber 18 as shown in FIG. 3 having an enlarged flared entryway at the wall portion 10. The chamber 18 further extends from the end 10 to the end 12. Slidably disposed therein is a cylindrical elongate piston 20 of dielectric material. The piston substantially fills the entire length of the chamber 18 except for the flared entryway thereof. One end 22 of the piston rod is disposed slightly recessed within the flared entryway, while the opposite end 24 of the piston has attached thereto a dielectric plate 26 more particularly shown in FIGS. 2, 3, and 4. As shown in FIG. 2 the plate 26 is normally against the end 12 of the body portion 2 and is retained resiliently seated thereagainst by the action of a pair of identical coil springs 28, one end of each elongate coil spring 28 is secured to the plate 26 while the other end of each spring 28 is secured on a corresponding finger 30 molded integral with the body portion 2. It is shown in FIG. 2 that the sides of the body portion 2 are substantially recessed at 32 thereby recessing the springs 28, the fingers 30 and the plate 26 from the outer peripheral sides 31 of the body portion 2. The body portion 2 further is provided with an encircling hollow shroud or shell 34 fitting flush with the outer peripheral sides 31. The shell may be slotted at 36 to receive the conductors 16 therethrough. Yet with reference to FIGS. 2 and 3, the plate 26 is further provided with a spaced pair of conducting rods 38 which are secured fast at one end within the plate 26 and which slightly protrude outwardly thereof. A resistor 40 of appropriate resistance has its leads 42 electrically bridged across the protruding ends of the rods 38. The other ends 44 of the rods extend within cavities 46 relatively deeply recessed within the end 12 parallel to the axis of the piston 20. The ends 44 of the rod further are compressibly engaged in abutment against relatively thin rectangular fingers 48 which project laterally outward from the contacts 14 disposed within the cavities 8. The fingers 48 thus communicate the corresponding male contacts 14 with the cavities 46 and the rods 44 thus provide a shorting path from one finger 48, through the resistor 40, through the other rod 44 to the finger 48. The contacts 14 within the cavities 8 are usually supplied with high voltage carried on the corresponding conductors 16. When the connector block is unmated, the contacts 14 although recessed within the cavities 8 are yet accessible and thereby at least partially exposed from the forward end 10 of the connector block. The residual high voltage normally remains impressed across the contacts due to slow decay or dissipation of the voltage. The residual voltage is directed away through the fingers 48 and the rods 44. The resistor 40 across the rods 44 is impressed with the high voltage and thereby serves as a current limiting load for dissipating the residual high voltage at a slow rate to prevent arcing or a fully short circuited condition seen by the high voltage. The danger of electrical shock and arcing on the part of the contacts 14 within the cavities 8 is thereby eliminated. The resistor may be replaced by a wire of low resistance if current limiting is not necessary.

As shown more particularly in FIGS. 1–4 the contacts 14 are recessed from open ends of the cavities and from the end 10 at carefully prescribed distances for a purpose to be described. A mateable connector block illustrated generally at 50 has a body portion 52 and a forward end 54 from which project integral dielectric sleeves 4′, 6′ and 8′ corresponding to the respective positions of the cavities 4, 6 and 8. The block 50 is provided with internal cavities 56 extending concentrically of corresponding sleeves 4′, 6′ and 8′ and communicating with a rearward end 58. In each sleeve is latchably secured an electrical receptacle contact 60 of any type wellknown in the prior art electrically connected respectively to an insulation covered electrical wires or conductors 62 extending within and projecting outwardly of corresponding cavities 56. The sleeves 4′, 6′ and 8′ project outwardly at different distances from forward end 54 of the body portion 52 for a purpose to be described. The body portion 52 further is provided with an integral dielectric projecting plunger 64 in alignment with the chamber 18 in which is disposed the piston 20.

In operation, the connector block 1 and 50 are to be intermated with the sleeves 4′, 6′ and 8′ being pluggably received within corresponding cavities 4, 6 and 8 such that the receptacle contacts 60 matingly receive sequentially the male electrical contacts 14. This advantageously reduces the amount of insertion force required to mate the conductor blocks together. In addition arcing over between adjacent contacts is eliminated.

Figure 4:
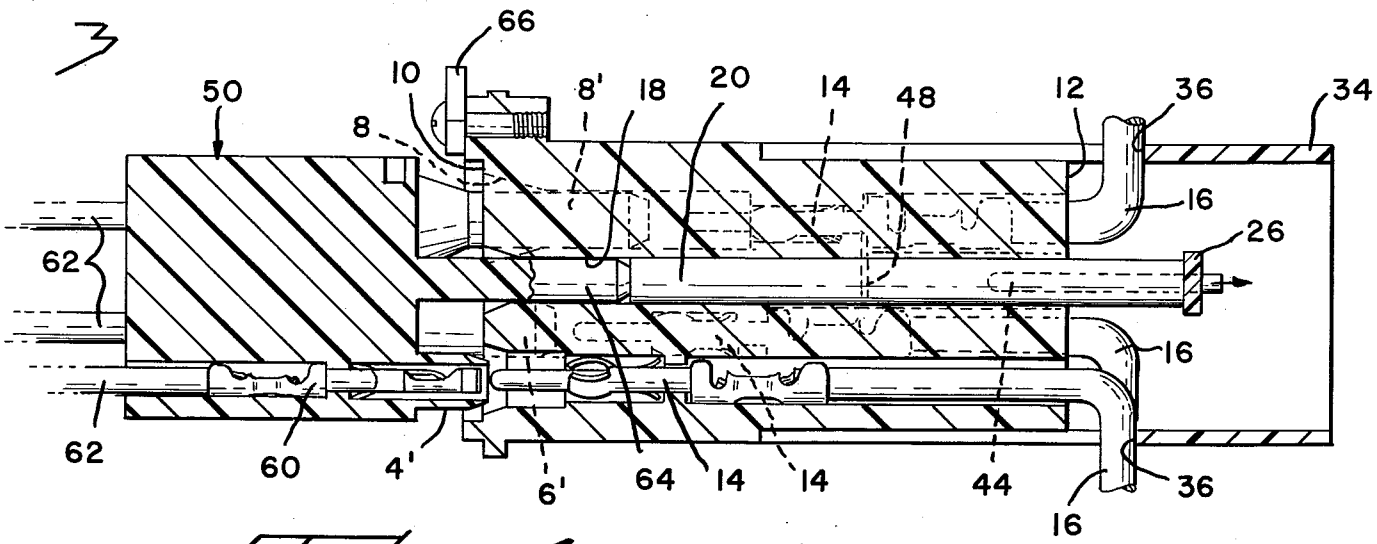
FIG. 4 is a view similar to FIG. 3 illustrating the connector block partially mated together.
Figure 5:
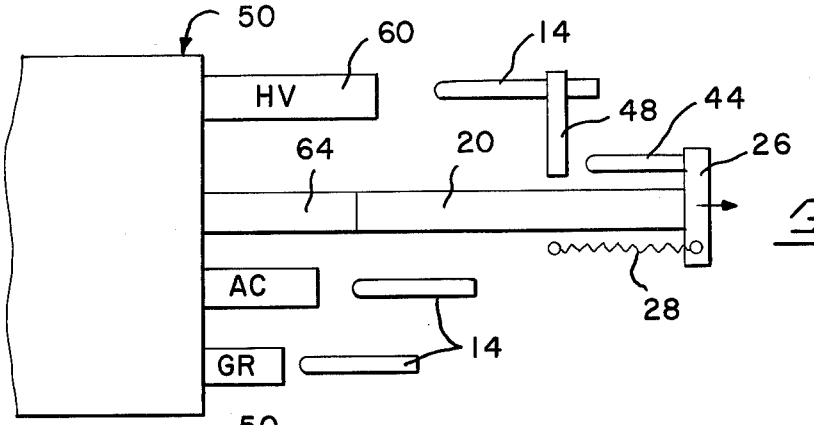
FIGS. 5, 6, 7 and 8 are diagrammatic elevations illustrating the sequence of electrical connections within the connector blocks as the connector blocks are being intermated.
Figure 6:
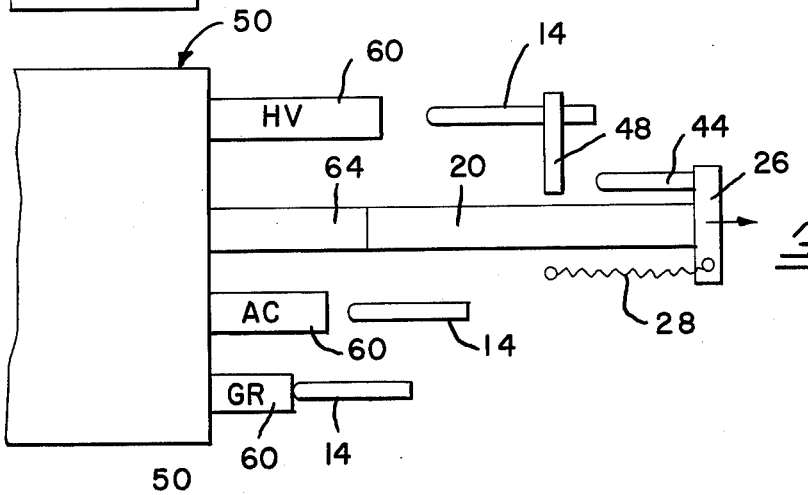

The sequence of operation is shown in FIGS. 5–8. The first mode of connection is illustrated in FIG. 5 when the sleeves 8′ enter cavities 8 and the plunger 64 enters the chamber 18 and engages the piston 20. As the connector blocks 1 and 50 are mated together the plunger 64 slidably urges piston 20 against the action of the coil springs 28 disconnecting the conducting rods 44 from the fingers 48. This accordingly disconnects the resistor 40 from the source of high voltage and allows the source of high voltge to be supplied at each of the contacts 14 within the cavities 8. The next step in the sequence of connection is shown in FIGS. 6 and 4 when the sleeve 4′ enters the cavity 4 and the contact 60 thereof matingly receives the contact 14 therein. This provides the first electrical connection as the contacts are being mated together (and the last electrical connection when the contacts are being disconnected from each other). Typically this connection is electrically the ground connection providing further electrical protection during mating or disconnection of the connector blocks. As shown in FIG. 4 the sleeves 6′ and 8′ are already deeply within the cavities 6 and 8 as the ground contact is being made. Thus the sleeves 6′ and 8′ plug the cavities 6 and 8 eliminating access thereto even before any electrical connection is made between the connector blocks.

Figure 7:
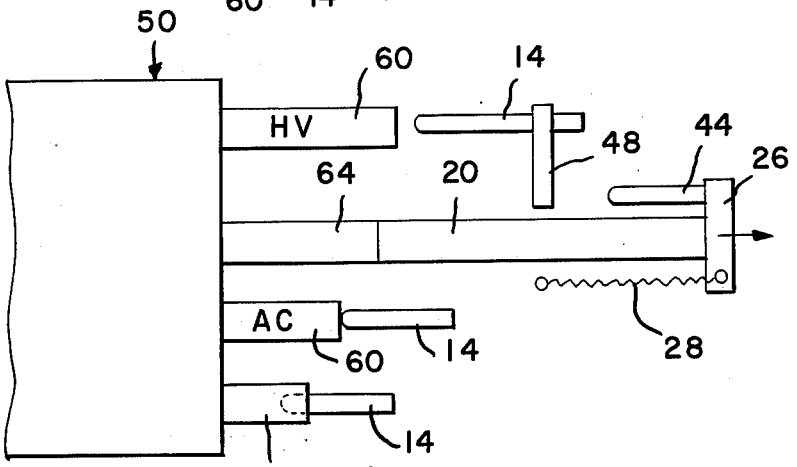

As shown in FIG. 7, the next connection to be made is between the contacts 60 and 14 within the sleeve 6′ and the cavity 6. This connection is made as the connector blocks are being mated and is the one closest to the ground connection previously made. This connection may be any type of signal carrying connection. For example this can be the AC voltage, as so labeled in FIG. 7, which supplies any load (not shown).

Figure 8:
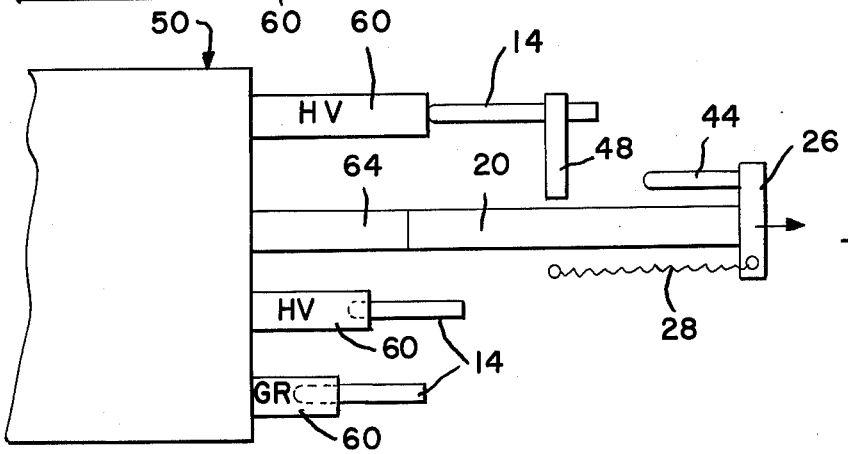

FIG. 8 illustrates the last connection to be made between the contacts 60 and 14 within the sleeves 8′ and the cavities 8. These connections typically are the high voltage connections, forming the return circuit paths from the load being supplied by the A.C. contacts 14 and 60 within the cavity 6 and the sleeve 6′, and are made substantially later in time after the resistor 40 is disconnected from the contacts 14 making the high voltage available to them. Thus the connections are made sequentially one at a time or plurally in sequence.

Once the connector blocks 1 and 50 are fully mated a latch 66 illustrated most particularly in FIG. 1 is pivoted about a screw pivot 68 to register within a recess 70 in the top of the connector block 50 latching the connector blocks 1 and 50 together. When the connector blocks are disconnected the sequence of operation shown in FIGS. 5–8 are reversed with the advantage being that A.C. is disconnected first, the shunting device removes residual voltage, and also the ground connection is the last to be broken. In addition the springs 28 forcibly urge the piston 20 toward the forward end 10 of the connector block 1 and thereby positively disconnect the connector block 50 from the connector block 1 and more importantly positively and quickly ensure that the resistor 40 is brought into engagement across the high voltage contacts 14 within the cavities 8 without delay.

Although a preferred embodiment of the present invention has been described and shown in detail other modifications and embodiments which would be apparent to one having ordinary skill in the art are intended to be covered by the spirit and scope of the appended claims.

What is claimed is:

1. A connector for mixed voltage signals with an auxiliary positive disablement of dangerous high voltage, comprising:

a first connector block having a plurality of electrical receptacles recessed within protruding insulative sleeves, a second connector block having a plurality of cavities matingly receiving said insulation sleeves therein, electrical conductors projecting into said cavities and secured to male electrical contacts for pluggable connection to said electrical receptacles, said second electrical connector block having a dielectric piston slidably mounted in a piston chamber and having a pair of conductive shorting rods engaging two of said male electrical contacts thereby connecting them together electrically, said first connector block having a projecting dielectric plunger insertable in said piston chamber for displacing said piston and disengaging said shorting rods from said corresponding male contacts prior to pluggable connection of said male contacts and said receptacle contacts but after receipt of said sleeves in said cavities.

2. The structure as recited in claim 1, wherein, said piston is provided with spring means for resiliently urging said shorting rods into engagement with said corresponding male contacts, said plunger slidably displacing said piston in opposition to said spring means.

3. The structure as recited in claim 2, and further including latching means for latching together said first and second connector blocks with said receptacles matingly engaging said male contacts.

4. The structure as recited in claim 1, wherein, said male contacts are mounted in said cavities at varied distances from open ends of said cavities thereby matingly engaging corresponding contacts at varied points in time as said sleeves are progressively inserted within said cavities.

* * * * *